US008733261B2

(12) United States Patent
Mizuno et al.

(10) Patent No.: US 8,733,261 B2
(45) Date of Patent: May 27, 2014

(54) APPARATUS AND NON-TRANSITORY COMPUTER-READABLE MEDIUM

(71) Applicants: Masahiro Mizuno, Nagoya (JP); Yin Hsuan Huang, Hseih (TW)

(72) Inventors: Masahiro Mizuno, Nagoya (JP); Yin Hsuan Huang, Hseih (TW)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 13/727,316

(22) Filed: Dec. 26, 2012

(65) Prior Publication Data

US 2013/0186315 A1 Jul. 25, 2013

(30) Foreign Application Priority Data

Jan. 19, 2012 (JP) ..... 2012-008547

(51) Int. Cl.
*D05B 21/00* (2006.01)

(52) U.S. Cl.
USPC ..... 112/102.5

(58) Field of Classification Search
USPC ..... 112/102.5, 470.04, 470.06, 475.05, 112/475.18, 475.19
See application file for complete search history.

(56) References Cited

U.S. PATENT DOCUMENTS 4,520,745 A * 6/1985 Shinomiya et al. ..... 112/475.19
5,915,315 A * 6/1999 Bentz ..... 112/103
6,167,822 B1 * 1/2001 Miyasako et al. ..... 112/102.5
7,814,851 B2 * 10/2010 Tashiro ..... 112/470.01
8,301,292 B2 * 10/2012 Tokura ..... 700/138

FOREIGN PATENT DOCUMENTS

JP A-63-211387 9/1988

* cited by examiner

*Primary Examiner* — Tejash Patel
(74) *Attorney, Agent, or Firm* — Oliff PLC

(57) ABSTRACT

An apparatus includes a processor and a memory configured to store computer-readable instructions that instruct the apparatus to perform the steps of acquiring first pattern data representing stitches that form a first pattern and second pattern data representing stitches that form a second pattern, the first pattern and the second pattern being two patterns to be sewn by embroidery in mutually adjacent positions, generating, in a case where the two patterns are to be sewn on a sewing object that is formed of a soluble material, connecting data representing a connecting stitch based on the first pattern data and the second pattern data, the and generating, from the acquired first pattern data, the acquired second pattern data and the generated connecting data, embroidery data to sew the two patterns and the connecting stitch.

12 Claims, 12 Drawing Sheets

APPARATUS AND NON-TRANSITORY COMPUTER-READABLE MEDIUM

CROSS-REFERENCE TO RELATED APPLICATION

This application claims priority to Japanese Patent Application No. 2012-008547, filed Jan. 19, 2012, the content of which is hereby incorporated herein by reference in its entirety.

BACKGROUND

The present disclosure relates to an apparatus that is capable of generating embroidery data to sew an embroidery pattern using an embroidery sewing machine, and to a non-transitory computer-readable medium storing computer-readable instructions that cause an apparatus to generate the embroidery data.

A technique is known that creates a so-called openwork pattern (lace embroidery, for example). For example, a method is known in which, after performing embroidery on a mesh portion on a base fabric that melts in heat or dissolves in water, the openwork pattern is formed by melting or dissolving the base fabric in the mesh portion.

SUMMARY

According to the above-described method, it is possible to generate an individual embroidery pattern that includes the openwork pattern. However, for example, there is a need to create a larger openwork pattern by connecting a plurality of one type of embroidery patterns that are arranged side by side, or by connecting a plurality of different embroidery patterns and so on. With the above-described method, it is not possible to meet this need.

As a method to create the larger openwork pattern by connecting the plurality of embroidery patterns, there may be a method in which, after individually creating a plurality of openwork patterns, the patterns are sewn together by hand, or a method in which edge portions of the plurality of embroidery patterns to be connected are overlapped and sewn. However, the method to sew the patterns together by hand may require a lot of time. Further, in a case where the patterns are overlapped and sewn, sewing quality may deteriorate due to the increase in thickness on the sections that are overlapped, and it is possible that a design shape of a sewing result may be different from an intended shape.

Various embodiments of the broad principles derived herein provide an apparatus capable of generating embroidery data to create a larger openwork pattern by connecting a plurality of embroidery patterns while maintaining a shape and sewing quality of each of the patterns, and to a non-transitory computer-readable medium storing computer-readable instructions that may cause an apparatus to generate the embroidery data.

Exemplary embodiments herein provide an apparatus that includes a processor and a memory configured to store computer-readable instructions. The computer-readable instructions instruct, when executed, the apparatus to perform the steps of acquiring first pattern data and second pattern data, the first pattern data being data representing stitches that form a first pattern, the first pattern being one of two patterns that are to be sewn by embroidery in mutually adjacent positions, and the second pattern data being data representing stitches that form a second pattern that is another of the two patterns, generating, in a case where the two patterns are to be sewn on a sewing object that is formed of a soluble material, connecting data based on the first pattern data and the second pattern data, the connecting data being data representing a connecting stitch, the connecting stitch being a stitch that is configured to connect the two patterns and that intersects with an outer contour of the first pattern and an outer contour of the second pattern, and generating, from the acquired first pattern data, the acquired second pattern data and the generated connecting data, embroidery data to sew the two patterns and the connecting stitch.

Exemplary embodiments also provide a non-transitory computer-readable medium storing computer-readable instructions. The computer-readable instructions instruct, when executed, an apparatus to execute steps comprising acquiring first pattern data and second pattern data, the first pattern data being data representing stitches that form a first pattern, the first pattern being one of two patterns that are to be sewn by embroidery in mutually adjacent positions, and the second pattern data being data representing stitches that form a second pattern that is another of the two patterns, generating, in a case where the two patterns are to be sewn on a sewing object that is formed of a soluble material, connecting data based on the first pattern data and the second pattern data, the connecting data being data representing a connecting stitch, the connecting stitch being a stitch that is configured to connect the two patterns and that intersects with an outer contour of the first pattern and an outer contour of the second pattern, and generating, from the acquired first pattern data, the acquired second pattern data and the generated connecting data, embroidery data to sew the two patterns and the connecting stitch.

BRIEF DESCRIPTION OF THE DRAWINGS

Embodiments will be described below in detail with reference to the accompanying drawings in which.

DETAILED DESCRIPTION

Hereinafter, an embodiment of the present disclosure will be explained with reference to the drawings. First, a configuration of an embroidery data generating apparatus 1 will be explained with reference to FIG. 1. The embroidery data generating apparatus 1 is an apparatus that can generate embroidery data to sew an embroidery pattern on a sewing object using an embroidery sewing machine 3 (refer to FIG. 2) that will be described later. The sewing object may be, for example, a work cloth, a water-soluble sheet, a heat-soluble sheet or the like.

Figure 1:
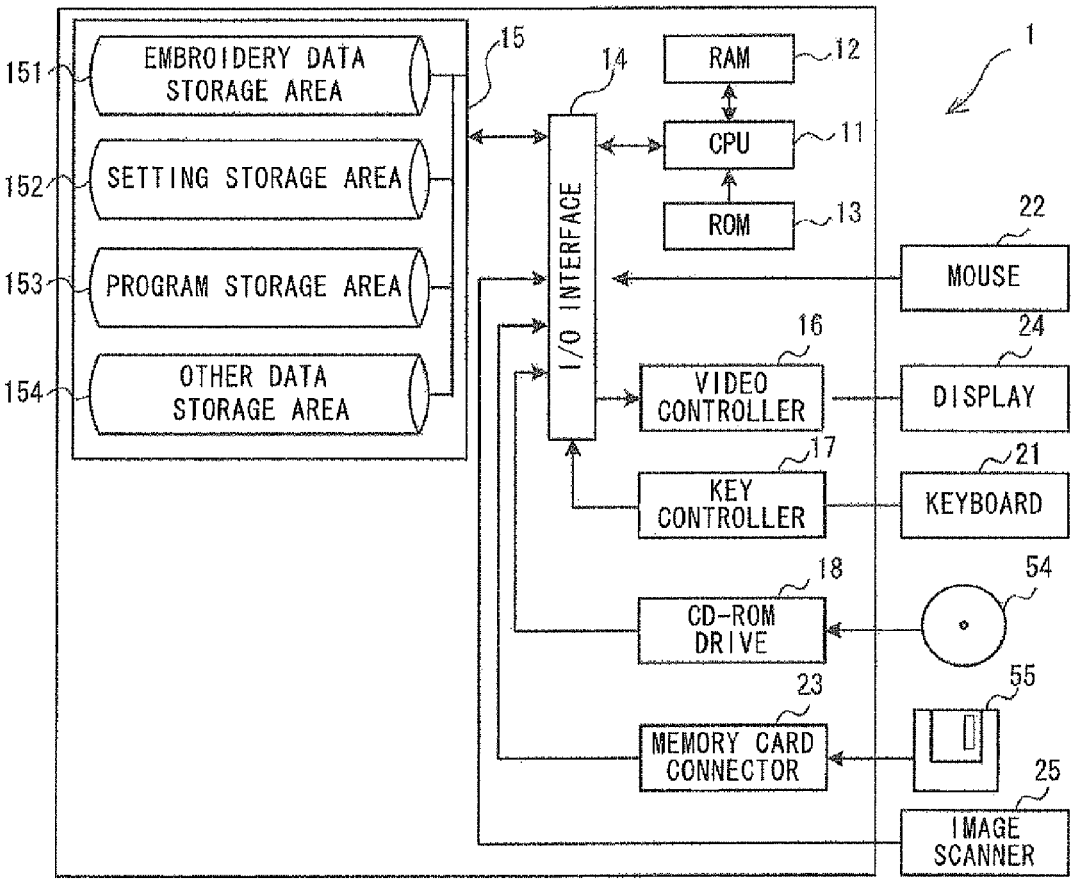
FIG. 1 is a block diagram showing an electrical configuration of an embroidery data generating apparatus.

The embroidery data generating apparatus 1 may be an apparatus that is dedicated for use in generating embroidery data or may be a general-purpose device, such as a so-called personal computer. In the present embodiment, the general-purpose device is exemplified. As shown in FIG. 1, the embroidery data generating apparatus 1 includes a CPU 11 that is a controller that is configured to control the embroidery data generating apparatus 1. A RAM 12, a ROM 13, and an input/output (I/O) interface 14 are connected to the CPU 11.

The RAM 12 is configured to temporarily store various data. The ROM 13 is configured to store a BIOS and so on. The I/O interface 14 is configured to mediate in the exchange of data. A hard disk device (HDD) 15, a mouse 22 as an input device, a video controller 16, a key controller 17, a CD-ROM drive 18, a memory card connector 23 and an image scanner 25 are connected to the I/O interface 14. Although not shown in FIG. 1, the embroidery data generating apparatus 1 may also include an external interface that allows connection to an external device or a network.

A display 24 as a display device is connected to the video controller 16. A keyboard 21 as an input device is connected to the key controller 17. A CD-ROM 54 can be inserted into the CD-ROM drive 18. For example, at a time of setup of an embroidery data generating program, the CD-ROM 54 storing the embroidery data generating program may be inserted into the CD-ROM drive 18. Then, the embroidery data generating program may be read and stored in a program storage area 153 of the HDD 15. The embroidery data generating program may also be acquired from the external device or via the network and stored in the program storage area 153. A memory card 55 can be connected to the memory card connector 23, and information can be read from and written to the memory card 55.

Storage areas of the HDD 15 will be explained. As shown in FIG. 1, the HDD 15 includes a plurality of storage areas, including an embroidery data storage area 151, a setting storage area 152, the program storage area 153 and an other data storage area 154. The embroidery data storage area 151 may store embroidery data. The embroidery data is data that represents stitches to form a pattern that is sewn by embroidery. The embroidery data of the present embodiment is data to be used when performing embroidery using the embroidery sewing machine 3, and includes at least data relating to needle drop points (coordinate values of an XY coordinate system that is specific to the embroidery sewing machine 3) and to a sewing order of the needle drop points. The embroidery data may also include data relating to colors of embroidery threads, corresponding to each pattern. Note that, hereinafter, a pattern for which the embroidery data is stored in the embroidery data storage area 151 is referred to as a stored pattern.

Various setting values to be used in various processing executed by the embroidery data generating apparatus 1 may be stored in the setting storage area 152. A plurality of programs to be executed by the CPU 11, including the embroidery data generating program, may be stored in the program storage area 153. Initial values and setting values of various parameters, for example, may be stored in the other data storage area 154. It should be noted that the embroidery data generating program may be stored in the ROM 13 or may be stored in another storage area (a flash ROM etc).

Figure 2:
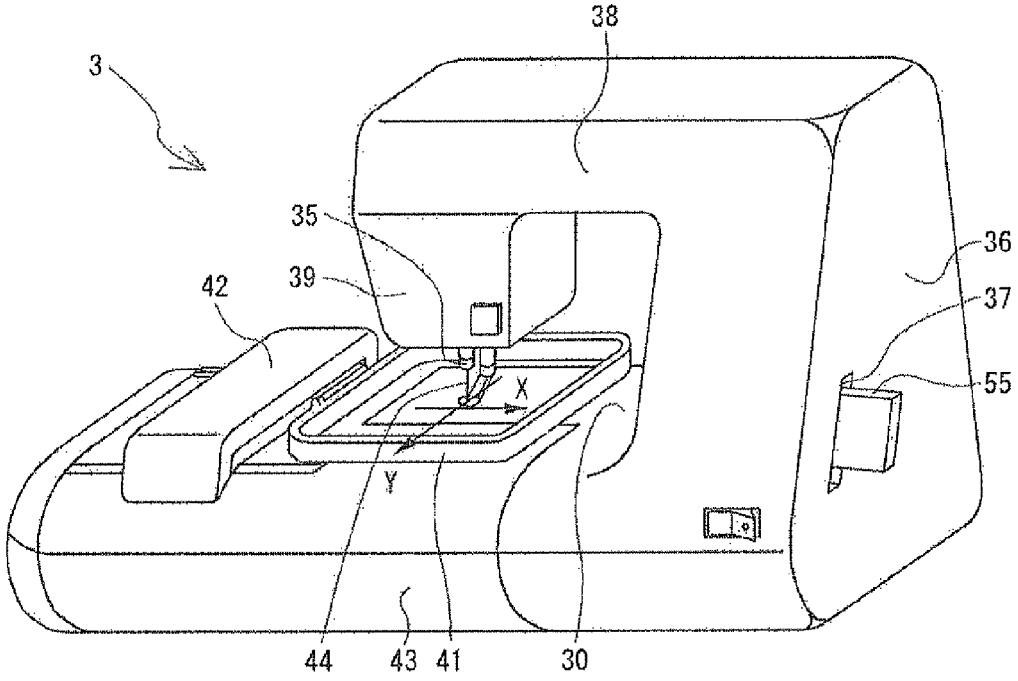
FIG. 2 is an external view of an embroidery sewing machine.

The embroidery sewing machine 3 will be explained with reference to FIG. 2. The embroidery sewing machine 3 is a sewing machine that can sew an embroidery pattern based on the embroidery data. As shown in FIG. 2, the embroidery sewing machine 3 includes a bed 30, a pillar 36, an arm 38, and a head 39. The long dimension of the bed 30 runs left to right. The pillar 36 rises upward from the right end of the bed 30. The arm 38 extends to the left from the upper portion of the pillar 36. The head 39 is joined to the left end of the arm 38.

An embroidery frame 41 may be disposed above the bed 30. The embroidery frame 41 is configured to hold a work cloth (not shown in the drawings) on which embroidery will be performed. A Y direction drive portion 42 and an X direction drive mechanism (not shown in the drawings) may move the embroidery frame 41 to a position that is indicated by a coordinate value of the XY coordinate system that is specific to the embroidery sewing machine 3. The X direction drive mechanism is housed in a main body case 43. A needle bar 35 on which a sewing needle 44 is mounted and a shuttle mechanism (not shown in the drawings) may be driven in conjunction with the moving of the embroidery frame 41. In this manner, the embroidery pattern is formed on the work cloth. The Y direction drive portion 42, the X direction drive mechanism and the needle bar 35 may be controlled by a control device (not shown in the drawings) that is built into the embroidery sewing machine 3. The control device may be formed of a microcomputer or the like.

A memory card slot 37 may be provided in a side face of the pillar 36 of the embroidery sewing machine 3. The memory card 55 can be inserted into and removed from the memory card slot 37. For example, embroidery data that has been generated by or edited by the embroidery data generating apparatus 1 (refer to FIG. 1) may be stored on the memory card 55 via the memory card connector 23. Then, the memory card 55 may be inserted in the memory card slot 37, the stored embroidery data may be read and the embroidery data may be stored in the embroidery sewing machine 3. Based on the embroidery data supplied from the memory card 55, the control device (not shown in the drawings) of the embroidery sewing machine 3 may automatically control embroidery sewing operations by the above-described structural members, In this way, the embroidery sewing machine 3 can sew the embroidery pattern based on the embroidery data supplied from the embroidery data generating apparatus 1.

Figure 3:
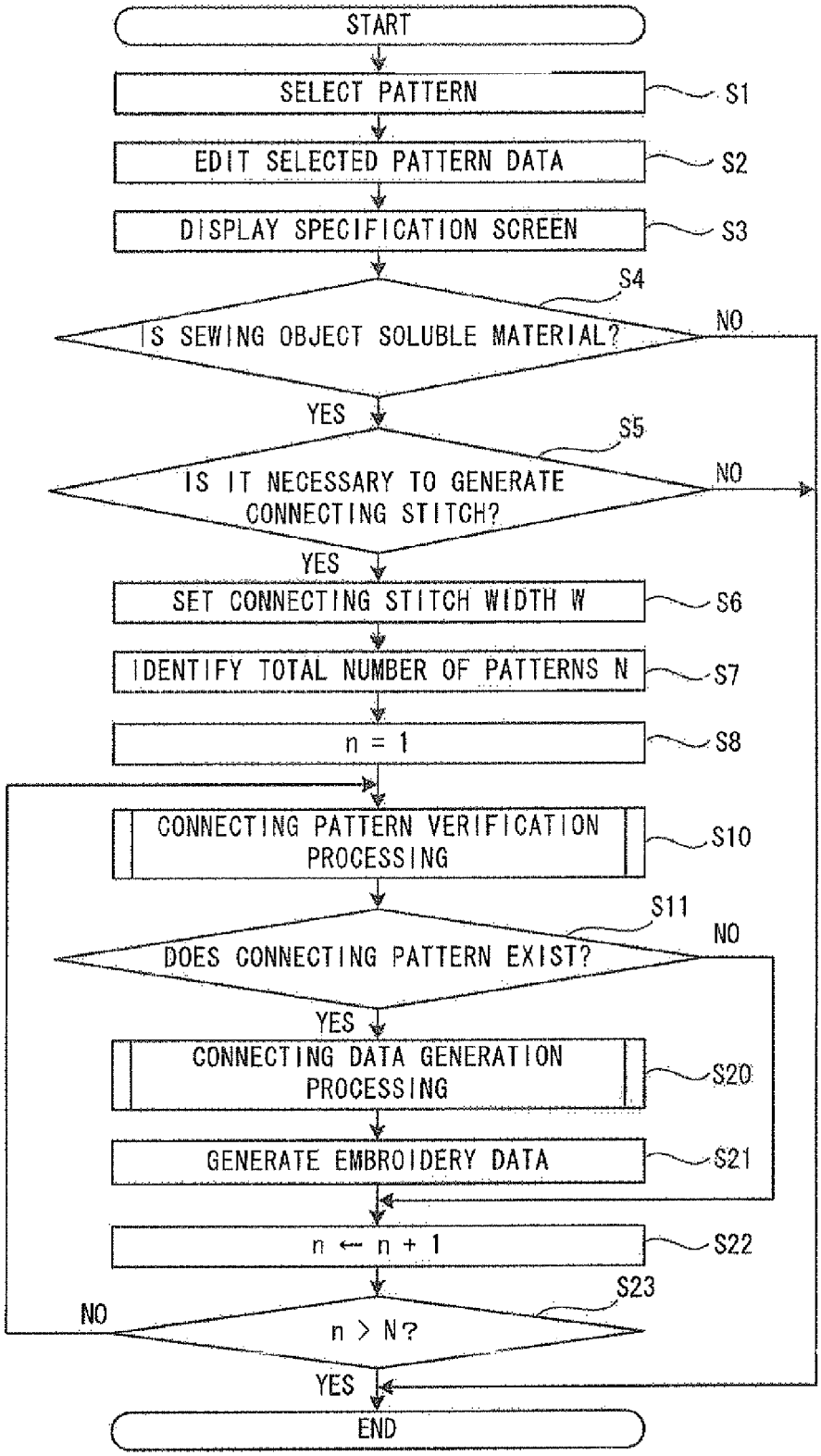
FIG. 3 is a flowchart of main processing of the embroidery data generating apparatus.

Main processing executed by the embroidery data generating apparatus 1 will be explained with reference to FIG. 3 to FIG. 12. The main processing shown in FIG. 3 is started when a command to start the processing is input by a user. The CPU 11 reads the embroidery data generating program stored in the HDD 15 shown in FIG. 1, and performs the following processing by executing computer-readable instructions that are included in the program.

As shown in FIG. 3, after the main processing is started, the CPU 11 identifies a pattern selected by the user that is to be a target of embroidery sewing (step S1). More specifically, for example, the CPU 11 displays, on the display 24 of the embroidery data generating apparatus 1, a screen (not shown in the drawings) that shows a list of stored patterns and an Enter key. When the Enter key is selected after the user has selected a desired pattern by operating the mouse 22 and the keyboard 21, the CPU 11 identifies the pattern that has been selected (hereinafter referred to as a selected pattern), acquires embroidery data of the selected pattern (hereinafter referred to as selected pattern data) from the embroidery data storage area 151 of the HDD 15 and stores the selected pattern data in the RAM 12.

At step S1, the user can select a plurality of patterns. In this case, the CPU 11 acquires a plurality of sets of selected pattern data that correspond to the plurality of selected patterns, respectively, and stores the plurality of sets of selected pattern data in the RAM 12 in an order of selection. Note that the pattern to be sewn by embroidery is not limited to the stored pattern and may be, for example, a pattern for which embroidery data has been stored in the memory card 55 or in the external device. In such a case, the CPU 11 may read the selected pattern data from the memory card 55 or the external device and store the data in the RAM 12.

The CPU 11 performs editing of the selected pattern data (step S2). At step S2, for example, the CPU 11 displays, on the display 24 of the embroidery data generating apparatus 1, an editing screen (not shown in the drawings) that includes an area displaying the selected pattern, various keys to edit the pattern and an Enter key. First, in the area displaying the selected pattern, the selected pattern is displayed in a size and layout determined by initial settings. The editing of the pattern may be, for example, changing the size of the pattern (scaling up, scaling down) and changing the layout of the pattern (moving, or rotating etc.). By selecting the various keys, the user can input commands to edit the selected pattern as desired.

Figure 4:
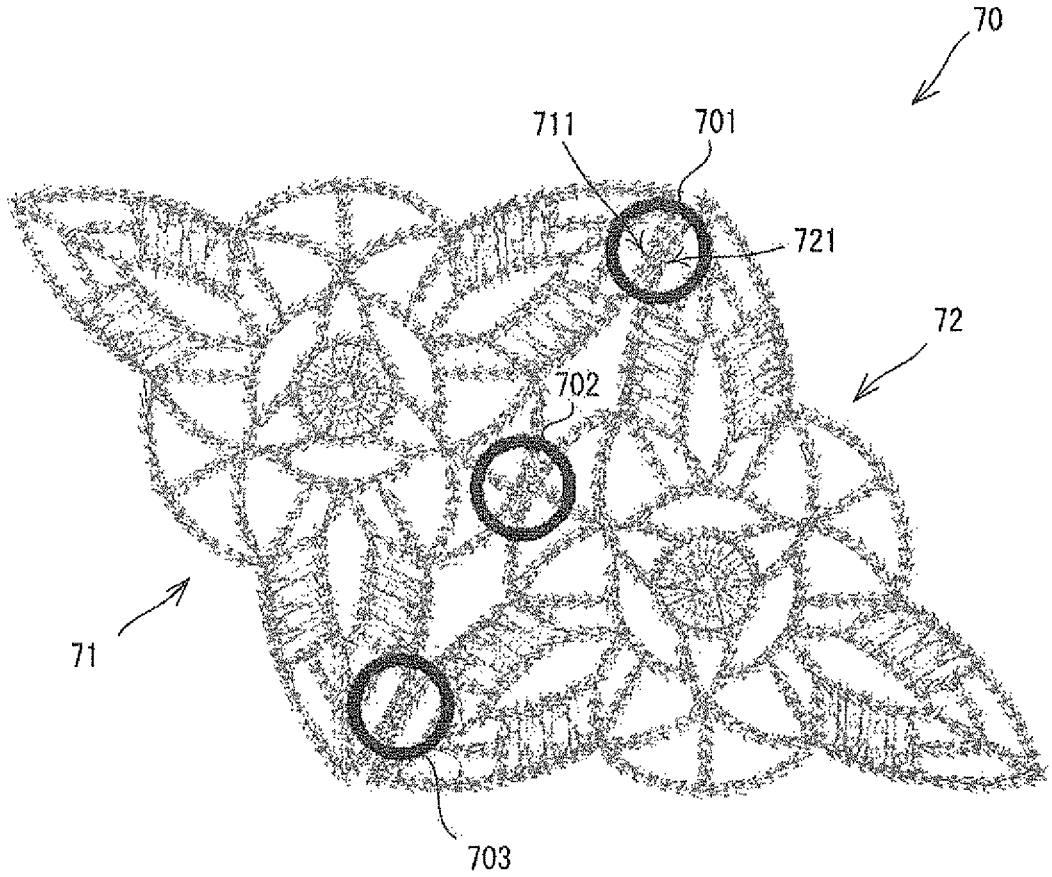
FIG. 4 is an explanatory diagram of an example of a pattern in which two patterns are combined.

For example, in a case where a user wishes to create a single openwork pattern by connecting a plurality of the stored patterns, the user selects the plurality of patterns while watching the screen, and changes a size and layout of the selected patterns as appropriate. FIG. 4 shows an example in which a pattern 71 and a pattern 72 are identified as the selected patterns at step S1, and at step S2, in order to create a pattern 70 that is a combination of the pattern 71 and the pattern 72, a layout of the pattern 71 and the pattern 72 is changed such that the pattern 71 and the pattern 72 are substantially in contact with each other in three portions respectively enclosed by bold lines 701, 702 and 703. Note that the pattern 72 is a pattern obtained by rotating the same pattern as the pattern 71. When the Enter key is selected after the editing of the pattern has been performed as necessary, the CPU 11 confirms the editing content, and corrects the selected pattern data read at step S1 in accordance with the editing content. Specifically, the CPU 11 changes the coordinate values representing the needle drop points included in the selected pattern data in accordance with the editing content.

After editing the selected pattern, the CPU 11 displays, on the display 24, a specification screen (not shown in the drawings) that is used to specify design features of the selected pattern (step S3). Design features of the selected pattern may include, for example, classification of the sewing object, whether or not it is necessary to create a connecting stitch, a length of a single stitch to form the connecting stitch and so on.

The classification of the sewing object is whether or not the sewing object is a soluble material (water-soluble or heat-soluble, for example). When the user wishes to create the openwork pattern from the selected patterns, the soluble material is used as the sewing object, and thus, the sewing object is specified as being the soluble material. Even if the plurality of patterns are arranged on the assumption that the patterns are connected to form one pattern, if these patterns are sewn in accordance with the respective embroidery data only and then the sewing object is subsequently dissolved, the pattern breaks up into the individual patterns. The connecting stitch is at least one stitch to be sewn in such a case that is configured to connect two patterns and that intersects with outer contours of the two patterns. The connecting stitch will be explained in more detail later.

Next, the CPU 11 determines whether or not the sewing object has been specified as the soluble material on the specification screen (step S4). Even when the plurality of patterns are arranged such that the patterns are in mutual contact, if the sewing object is not the soluble material (no at step S4), there is no particular need to add the connecting stitch to connect the patterns. Thus the CPU 11 ends the main processing. In a case where the sewing object is the soluble material (yes at step S4), the CPU 11 determines whether or not it has been specified that creation of the connecting stitch is necessary (step S5). Even if the sewing object is the soluble material and the plurality of patterns are selected, the user may specify that the creation of the connecting stitch is not necessary, such as when the user wishes to use the patterns as the individual openwork patterns. Thus, when it is specified that the creation of the connecting stitch is not necessary (no at step S5), the CPU 11 ends the main processing.

On the other hand, in a case where it is specified that the creation of the connecting stitch is necessary (yes at step S5), the CPU 11 sets data indicating a length input from the specification screen as a connecting stitch length W and stores the connecting stitch length W in the RAM 12 (step S6). The length of the connecting stitch is a length of one stitch that forms the connecting stitch. The user can specify a desired connecting stitch length W (5 mm, for example) while taking into account the plurality of selected patterns to be connected. In this case, in order to maintain the plurality of selected patterns in a connected state even after the sewing object is dissolved, it is necessary for the connecting stitch length W to be longer than a threshold value D1 that will be explained later at least. Further, if a substantial length of a stitch that can be formed using a sewing needle 44 is taken into account, it is preferable for the connecting stitch length W to be approximately 2 mm, at least. In addition, in order to more reliably connect two of the patterns, it is preferable for the connecting stitch length W to be equal to or more than 3 mm.

It should be noted that there is no upper limit for the connecting stitch length W. The user may specify a suitable value depending on a width of stitches forming the outer contours of the plurality of selected patterns to be connected and a type of stitches filling the selected patterns. For example, in a case where a density of the stitches filling the selected patterns is relatively high and in a case where the connecting stitch is to be sewn in advance of the selected patterns, as will be described later, the impact of the connecting stitch on the appearance of the selected patterns may be small. Thus, in order to make the connecting stitch secure, the connecting stitch may be long to a certain degree. In contrast, in a case where almost none of the stitches filling the selected patterns are to be formed, namely, in a case where the stitches forming the selected patterns are substantially only the stitches forming the outer contours (ring-shaped stitches, for example), it is preferable for the connecting stitch length W to be set such that the connecting stitch will not protrude significantly from the stitches that form the outer contours.

At step S6, the CPU 11 may identify the width of the stitches forming the outer contour of the selected pattern and the type of the stitches filling the selected pattern based on the coordinate value data of the needle drop points included in the selected pattern data and may thereby automatically set the suitable connecting stitch length W, as described above.

Next, the CPU 11 performs processing to generate the embroidery data in which the connecting stitch has been added to the plurality of selected patterns (step S7 to step S23). The CPU 11 first identifies a total number N of the selected patterns (hereinafter referred to as a number of patterns N) that have been selected at step S1 and for which the corresponding selected pattern data has been acquired and stored in the RAM 12, and stores the number N in the RAM 12 (step S7). The CPU 11 sets a counter value n that is stored in the RAM 12 to an initial value of 1 (step S8). n is a variable that is used to sequentially process the N selected patterns. In the example shown in FIG. 4, after the number of patterns N is identified as being 2 at step S7, the CPU 11 sets the first pattern 71 as a processing target. Next, the CPU 11 performs connecting pattern verification processing, with an n-th selected pattern as the processing target (step S10, FIG. 5). The connecting pattern verification processing is processing to verify the presence or absence of a connecting pattern and identify the connecting pattern, if the connecting pattern exists. The connecting pattern is another selected pattern that is to be connected to the n-th selected pattern (which is the processing target, hereinafter referred to as a pattern n) using the connecting stitch and whose order is after the pattern n.

Figure 5:
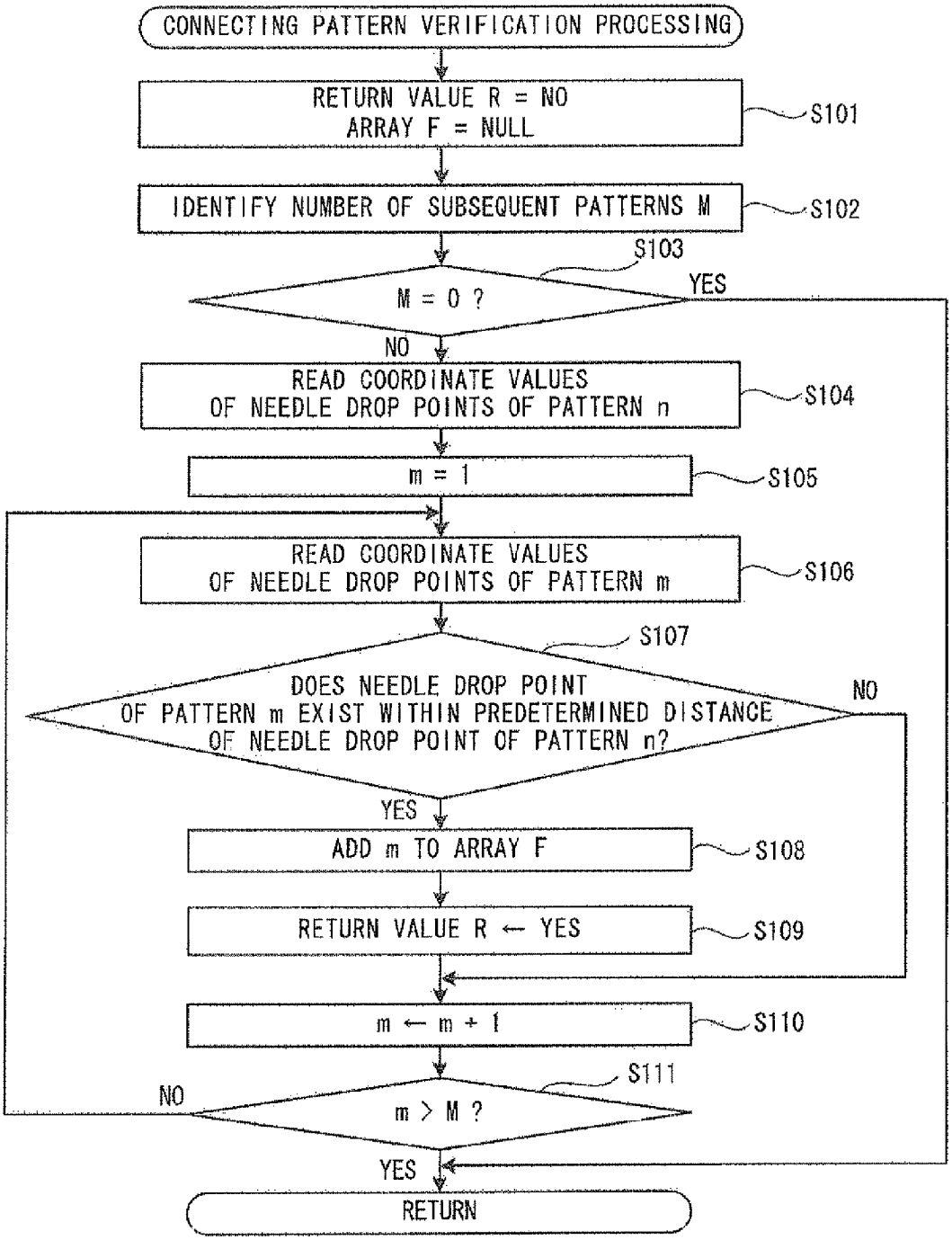
FIG. 5 is a flowchart of connecting pattern verification processing that is performed in the main processing.

As shown in FIG. 5, in the connecting pattern verification processing, first, a return value R and an array F that are stored in the RAM 12 are reset (step S101). The return value R is a value indicating whether or not the a connecting pattern to be connected to the pattern n exists. If R is a value indicating "YES", the connecting pattern exists. If R is a value indicating "NO", the connecting pattern does not exist. The array F is an array that is prepared in order to store identification information to identify the connecting pattern to be connected to the pattern n. At step S101, the CPU 11 sets the return value R to the value indicating "NO" and sets "NULL," which indicates that nothing has been stored, in the array F.

The CPU 11 identifies a number M of the selected patterns that are subsequent, in order, to the processing target pattern n (hereinafter referred to as a number of subsequent patterns M) (step S102). The selected pattern that is subsequent in order to the pattern n is hereinafter simply referred to as a subsequent pattern. The CPU 11 determines whether or not the number of subsequent patterns M is zero (0) (step S103). When the number of subsequent patterns M is not zero (no at step S103), the CPU 11 reads coordinate values of needle drop points V1 to Vi, from the selected pattern data of the pattern n that has been acquired and stored in the RAM 12 (step S104). The CPU 11 sets a counter value m stored in the RAM 12 to an initial value of 1 (step S105). in is a variable that is used to sequentially process the M subsequent patterns. The CPU 11 also reads coordinate values W1 to Wj of needle drop points from the selected pattern data of an m-th selected pattern of the subsequent patterns (hereinafter referred to as a pattern m) (step S106).

In the example shown in FIG. 4, the first selected pattern that is subsequent in order to the first pattern 71 is the pattern 72. Thus, at step S104 and step S106, the CPU 11 respectively reads coordinate values of needle drop points of the pattern 71 and the pattern 72.

Based on the coordinate values of the needle drop points V1 to Vi of the pattern n and of the needle drop points W1 to Wj of the pattern m, the CPU 11 determines whether or not any one of the needle drop points W1 to Wj of the pattern m exists within a predetermined distance of any one of the needle drop points V1 to Vi of the pattern n (step S107). More specifically, the CPU 11 sequentially takes one of the needle drop points V1 to Vi of the pattern n as a processing target, and calculates, sequentially, a distance dl between the processing target and each of the needle drop points W1 to Wj of the pattern m. If a pair of the needle drop points Vi and Wj exist between which the distance d1 is equal to or less than a threshold value D1, the CPU 11 determines that the needle drop point of the pattern m exists within the predetermined distance of the needle drop point of the pattern n.

Note that the distance dl between the needle drop point Vi of the pattern n and the needle drop point Wj of the pattern m can be calculated by the following formula, using the respective coordinate values (Vix, Viy) and (Wjx, Wjy) of the needle drop points Vi and Wj.

$$d1=\sqrt{\{(Vix-Wjx)^2+(Viy-Wjy)^2\}}$$

In a case where a plurality of the patterns are arranged such that the patterns are substantially in mutual contact and the connecting stitch is to be created, it is preferable that the threshold value D1 be set to be a value of approximately 0.3 mm to 0.5 mm, but another value may be adopted. The threshold value Dl may be stored in the setting storage area 152 of the HDD 15, for example, as a value that is set in advance. Alternatively, a value specified by the user may be used as the threshold value D1.

In a case where the pair of needle drop points Vi and Wj between which the distance d1 is equal to or less than the threshold value D1 has been identified (yes at step S107), the pattern m and the pattern n are in extremely close positions at one point, at least, and there is a high possibility that both the pattern m and the pattern n are arranged on the assumption that the pattern m and the pattern n will be connected. Thus, the CPU 11 associates identification information of the pattern m with identification information of the pattern n and additionally stores the associated identification information in the array F that has been prepared at step S101 (step S108). The CPU 11 updates the return value R to the value that indicates "YES" (step S109). In the example shown in FIG. 4, the CPU 11 determines that a needle drop point of the pattern 71 is within the predetermined distance of a needle drop point of the pattern 72, within at least one of the portions enclosed by the bold lines 701, 702 and 703. Therefore, the CPU 11 associates identification information of the pattern 71 with identification information of the pattern 72 and stores the associated identification information in the array F. Then, after updating the return value R to the value that indicates "YES," the CPU 11 advances the processing to step S110.

On the other hand, when no pair of the needle drop point Vi and Wj between which the distance d1 is equal to or less than the threshold value D1 are identified (no at step S107), the pattern m is not the connecting pattern to be connected to the pattern n. Therefore, the CPU 11 advances the processing to step S110.

At step S110, in order to determine whether or not the next pattern m is to be connected to the pattern n, the CPU 11 adds 1 to the counter value m (step S110). The CPU 11 determines whether or not the counter value m exceeds the number of subsequent patterns M identified at step S102 (step S111). In a case where the counter value m does not exceed the number of subsequent patterns M (no at step S111), another selected pattern still remains for which it is necessary to verify a layout relationship with the pattern n. Thus, the CPU 11 returns the processing to step S106, reads the coordinate values of the needle drop points of the next pattern m and performs the same processing as described above (step S107 to step S110). In the example shown in FIG. 4, when the patterns 71 and 72 are processed as the patterns n and m, the counter value m becomes 2. Thus, the counter value m exceeds the number of patterns that are subsequent in order to the pattern 71, which is 1 (yes at step S111). In such a case, there are no more selected patterns for which it is necessary to verify the layout relationship with the pattern n, and thus the CPU 11 ends the connecting pattern verification processing shown in FIG. 5 and returns to the main processing shown in FIG. 3.

As shown in FIG. 3, after the connecting pattern verification processing (step S10), the CPU 11 determines whether or not there is the connecting pattern with respect to the processing target pattern n (step S11). Specifically, in a case where the return value R stored in the RAM 12 is the value that indicates "YES," the CPU 11 determines that there is the connecting pattern with respect to the processing target pattern n (yes at step S11). In this case, the CPU 11 performs connecting data generation processing (step S20, FIG. 6). The connecting data generation processing is processing to generate connecting data, which is data representing the connecting stitch to be used to connect the pattern n with the connecting pattern of the pattern n.

Figure 6:
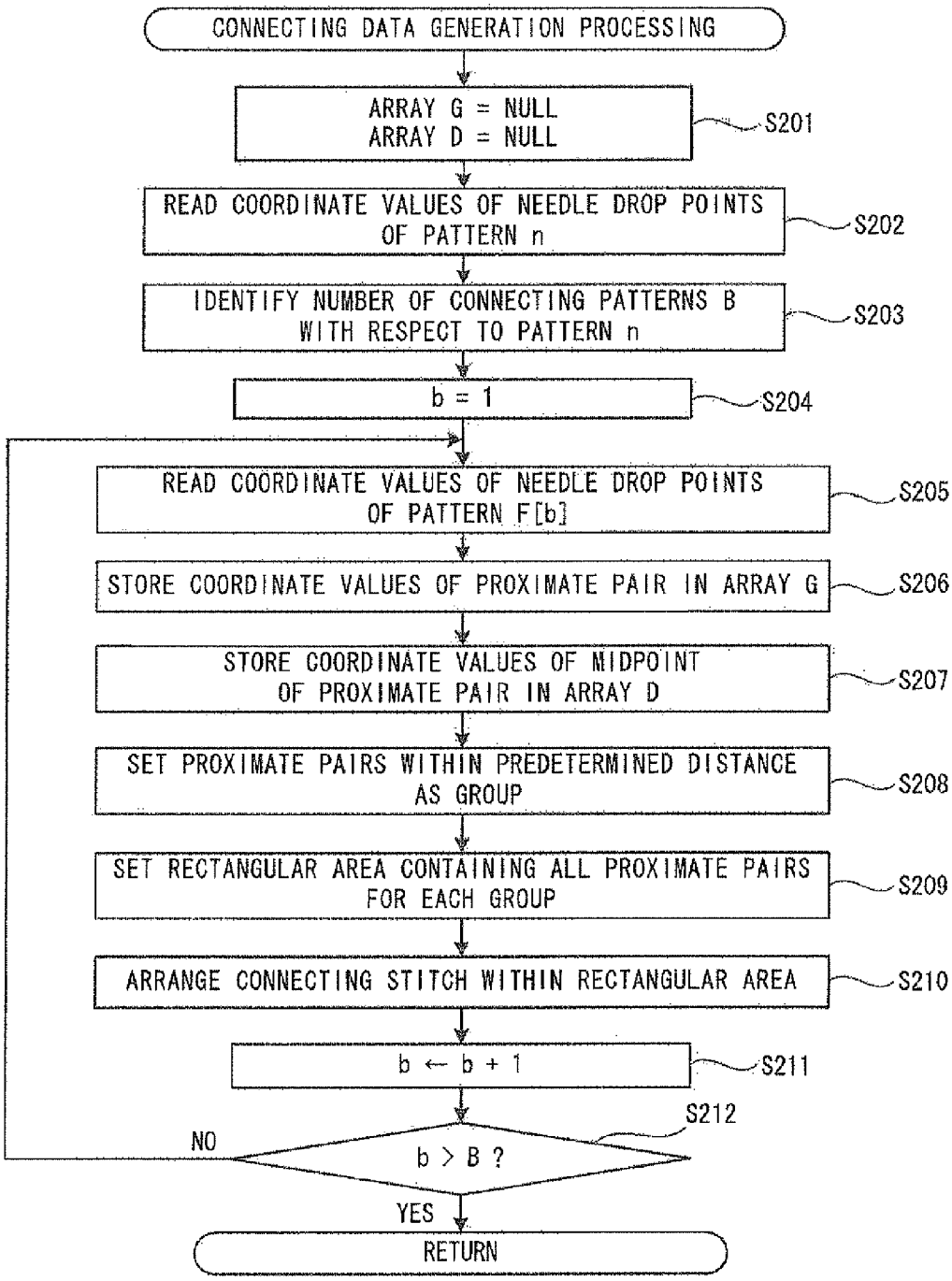
FIG. 6 is a flowchart of connecting data generation processing that is performed in the main processing.

As shown in FIG. 6, in the connecting data generation processing, the CPU 11 first resets an array G and an array D that are stored in the RAM 12 (step S201). The array G is an array that is prepared in order to sequentially store coordinate values of a pair (hereinafter referred to as a proximate pair) of a needle drop point of the pattern n and a needle drop point of the connecting pattern that are within the predetermined distance, namely, that are positioned in extremely close proximity to each other. The array D is an array that is prepared in order to store coordinate values of a midpoint of a line segment that connects the two needle drop points forming each proximate pair stored in the array G. At step S201, the CPU 11 sets "NULL", which indicates that nothing is stored, in each of the array G and the array D.

Next, the CPU 11 reads the coordinate values of all the needle drop points from the selected pattern data of the pattern n acquired and stored in the RAM 12 (step S202). The CPU 11 identifies a number of the pieces of identification information of the other pattern that are associated with the identification information of the pattern n and stored in the array F stored in the RAM 12, as a number of connecting patterns B with respect to the pattern n (step S203). The CPU 11 sets a counter value b stored in the RAM 12 to an initial value of 1 (step S204). The counter value b is a variable that is used to sequentially process the connecting patterns of the pattern n. The CPU 11 also reads the coordinate values of all the needle drop points of a b-th connecting pattern (hereinafter referred to as a pattern F [b]) of the pattern n in the array F, from the selected pattern data of the pattern F [b] (step S205).

The CPU 11 identifies one proximate pair of the needle drop point Vi of the pattern n and the needle drop point Wj of the pattern F [b] that are within the predetermined distance, and stores the coordinate values of the proximate pair in the array G (step S206). Specifically, in a similar manner to the determination processing at step S107 of the above-described connecting pattern verification processing (refer to FIG. 5), the CPU 11 sequentially calculates the distance dl between each of the needle drop points V1 to Vi of the pattern n and each of the needle drop points W1 to Wj of the pattern F [b]. The CPU 11 identifies, as the proximate pair, the needle drop point Vi and the needle drop point Wj between which the distance d1 is equal to or less than the threshold value Di (0.3 mm to 0.5 mm, for example). The CPU 11 adds to and stores in the array G the coordinate values (Vix, Viy) and (Wjx, Wjy) of the two needle drop points Vi and Wj that form the identified proximate pair. Note that, in a case where there are a plurality of needle drop points of the pattern F [b] for which the distance d1 from one of the needle drop points of the pattern n is equal to or less than the threshold value D1, one of the needle drop points for which the distance d1 is shortest is adopted for the proximate pair.

Figure 7:
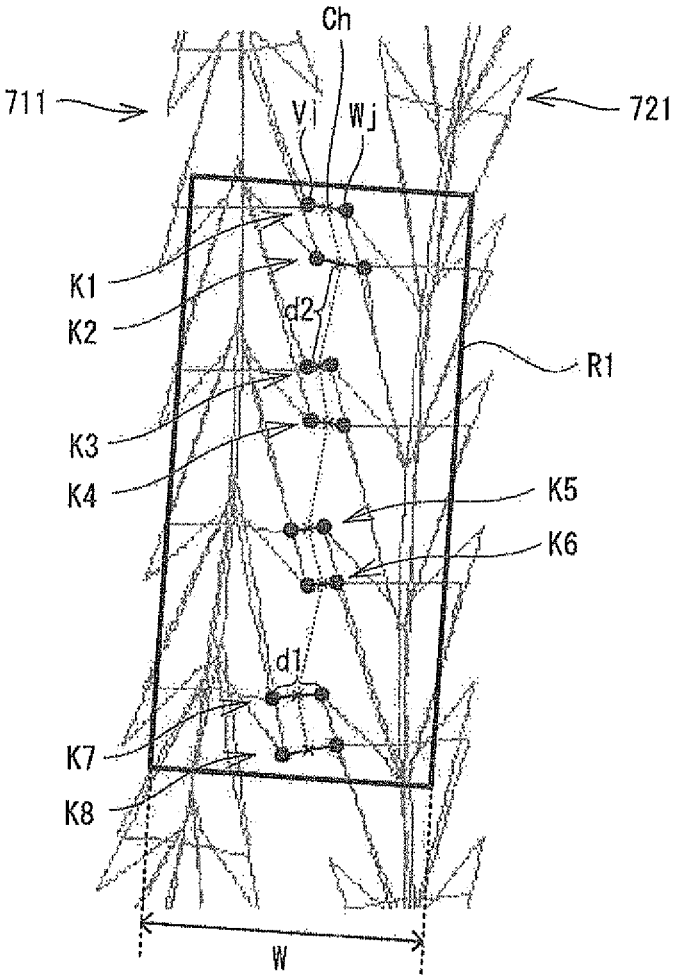
FIG. 7 is an explanatory diagram of an example of proximate pairs and a rectangular area.
Figure 8:
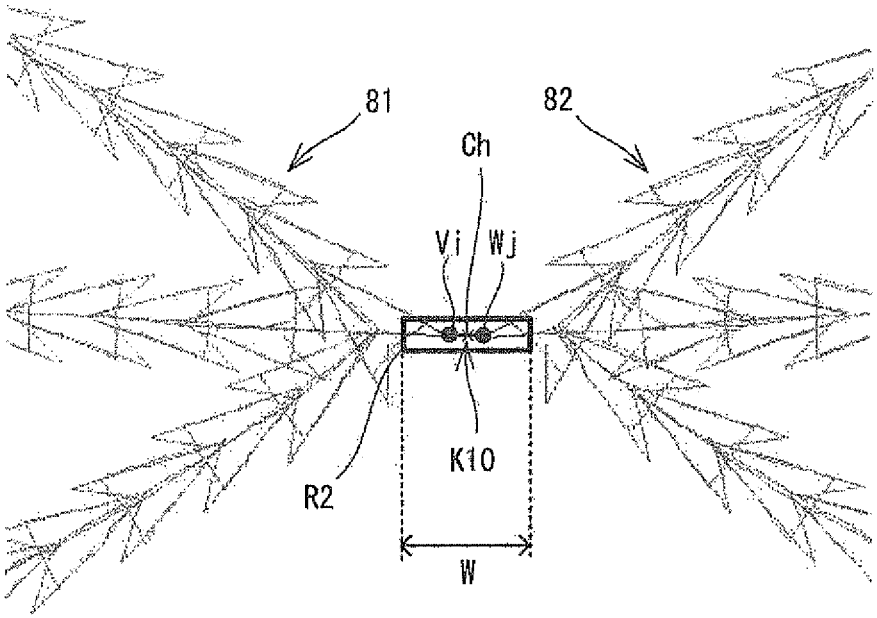
FIG. 8 is an explanatory diagram of another example of a proximate pair and a rectangular area.

In the example shown in FIG. 4, for the portions enclosed by the bold lines 701, 702 and 703, the CPU 11 identifies a plurality of proximate pairs, each including one of the needle drop points corresponding to stitches of the pattern 71 and one of the needle drop points corresponding to stitches of the pattern 72, and stores those coordinate values in the array G. For example, as shown in FIG. 7, the CPU 11 identifies 8 proximate pairs K1 to K8 for stitches 711 of the pattern 71 and stitches 721 of the pattern 72 in the portion enclosed by the bold line 701 (see FIG. 4). The CPU 11 performs the same processing for the portions enclosed by the bold lines 702 and 703.

When the CPU 11 ends the processing at step S206 for all the combinations of the needle drop points Vi of the pattern n and the needle drop points Wj of the pattern F [b], the CPU 11 calculates, from the coordinate values of the proximate pairs stored in the array G, the coordinate values of midpoints C1 to Ch of the respective proximate pairs. The CPU 11 associates the calculated coordinate values with identification information of the corresponding proximate pairs and stores the calculated coordinate values with the identification information in the array D (step S207). Specifically, the CPU 11 sequentially calculates the coordinate values of the midpoint Ch (Chx, Chy) of the proximate pair based on the coordinate values (Vix, Viy) and (Wjx, Wjy) of the two needle drop points Vi and Wj that form the proximate pair, in the following manner, and stores the calculated coordinate values in the array D.

$$(Chx, Chy)=((Vix+Wjx)/2,(Viy+Wjy)/2)$$

From among the proximate pairs identified at step S206, the CPU 11 sequentially identifies a proximate pair that is within a predetermined distance of an adjacent proximate pair, and sets the proximate pairs as one group (step S208). In the present embodiment, based on the coordinate values of the midpoint Ch stored in the array D at step S207, the CPU 11 sets, from among the proximate pairs, proximate pairs whose respective midpoints are within a predetermined distance of each other, as one group. Specifically, in a case where the coordinate values of the midpoints are stored in the array D, the CPU 11 takes one of the midpoints as a reference and calculates a distance d2 between the reference midpoint and another midpoint. The CPU 11 may calculate the distance d2 using the same formula as in the method of calculating the distance d1 between the needle drop point Vi and the needle drop point Wj.

In a case where the distance d2 from the other midpoint C2 to the midpoint C1 is equal to or less than a threshold value D2, the CPU 11 sets two pairs, namely, the proximate pair corresponding to the midpoint C1 and the proximate pair corresponding to the midpoint C2, as a same group. Further, in a case where the distance d2 from the other midpoint C3 to the midpoint C2 is equal to or less than the threshold value D2, the CPU 11 adds the proximate pair corresponding to the midpoint C3 to the same group.

A plurality of portions in which the two patterns are extremely close to each other may be in mutually separated positions. In order to avoid the connecting stitch that mutually connects the two patterns from being formed between these portions in such a case, it is preferable to set the threshold value D2 to approximately 10 mm. The threshold value D2 may be a value that is set in advance and stored in the setting storage area 152 of the HDD 15, for example. Alternatively, a value that is specified by the user may be used.

At step S208, the CPU 11 sequentially identifies the midpoints within the predetermined distance D2 in this way, and groups the corresponding proximate pairs. Note that, in a case where a plurality of midpoints are within a distance of the threshold value D2 from one midpoint, the CPU 11 identifies the midpoint positioned adjacent to the midpoint that has been taken as the reference. Namely, the CPU 11 identifies the midpoint positioned closest to the reference midpoint. Then, the CPU 11 may add the proximate pair corresponding to the identified midpoint to the same group.

In the example shown in FIG. 7, the distance d2 between the midpoints of the proximate pairs K1 and K2, K2 and K3, K3 and K4, K4 and K5, K5 and K6, K6 and K7, and K7 and K8 are, respectively, equal to or less than the threshold value D2. In this case, at step S208, the 8 proximate pairs K1 to K8 are set as one group. On the other hand, as shown in an example in FIG. 8, another midpoint of another proximate pair is not in the vicinity of the midpoint Ch of a proximate pair K10, due to a layout state between the selected patterns and to a shape of the selected patterns. In this case, the CPU 11 may set a group that only includes the proximate pair K10.

Next, the CPU 11 sets, for each group set at step S208, a rectangular area that contains all of the proximate pair or pairs included in the group (step S209). In the present embodiment, based on the coordinate values of all of the needle drop points corresponding to the proximate pair or pairs included in each group, the CPU 11 sets the rectangular area that contains all of these needle drop points, such that a length of a pair of opposite sides of the rectangular area is equal to the connecting stitch length W set at step S6 in the main processing (refer to FIG. 3). Note that the connecting stitch length W is at least larger than the threshold value D1, which is the maximum distance between the two needle drop points that form the proximate pair. Thus, the set rectangular area partially overlaps with the pattern n and with the pattern F [b]. The CPU 11 stores coordinate values of the four vertices of the set rectangular area in the RAM 12.

Note that, in a case where a plurality of proximate pairs are included in one group, it is preferable for the pair of opposite sides of the rectangular area having the connecting stitch length W to be arranged such that the opposite sides extend in a direction that intersects with all the line segments connecting the midpoints of the proximate pairs within the group. On the other hand, in a case where only one proximate pair is included in one group, it is preferable for the pair of opposite sides of the rectangular area having the connecting stitch length W to be arranged such that the opposite sides extend substantially in parallel to the line segment connecting the two needle drop points forming the proximate pair. In this way, the connecting stitch that is later arranged within the rectangular area more reliably intersects with the outer contours of the two patterns, and it is thus possible to connect the two patterns.

In the example shown in FIG. 7, as described above, the proximate pairs K1 to K8 are set as the one group. Thus, a rectangular area R1 is set that contains all the needle drop points forming the proximate pairs K1 to K8, and a pair of opposite sides of the rectangular area R1 having the connecting stitch length W are arranged to extend in a direction that intersects with all of the line segments connecting the respective midpoints of the proximate pairs K1 to K8. On the other hand, in the example shown in FIG. 8, the one group is formed of the proximate pair K10 only, and thus, a rectangular area R2 is set that contains the two needle drop points that form the proximate pair K10, and a pair of opposite sides of the rectangular area R2 having the connecting stitch length W are arranged to extend in a direction that is substantially parallel to a line segment that connects those two needle drop points.

Figure 9:
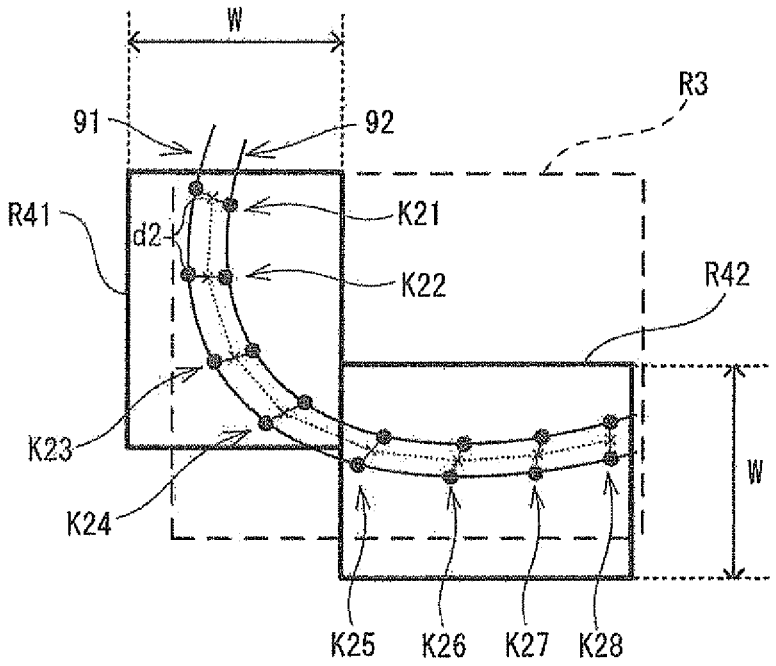
FIG. 9 is an explanatory diagram of yet another example of proximate pairs and rectangular areas.

It should be noted that, even if the distance d2 between the midpoints of the proximate pairs is equal to or less than the threshold value D2 that is used when grouping the proximate pairs at step S208, there may be a case in which a rectangular area that satisfies the above-described conditions cannot be set. For example, as shown in FIG. 9, even if the distance d2 between any two midpoints of proximate pairs K21 to K28 is equal to or less than the threshold value D2, there is a case in which lengths of sides of a rectangular area R3 that contains all the needle drop points of the proximate pairs K21 to K28 are greater than the connecting stitch length W. In such a case, at step S209, for example, the CPU 11 may form one group that includes only the proximate pairs K21 to K24 that can be contained by a rectangular area R41 that satisfies the above-described conditions, and may separately form another group that includes the remaining proximate pairs K25 to K28 that can be contained by a rectangular area R42 that satisfies the above-described conditions.

When the rectangular area is set at step S209 in the manner described above, the CPU 11 arranges the connecting stitch within the rectangular area and generates the connecting data (step S210). More specifically, the CPU 11 sets needle drop points to form at least one stitch that is parallel to the opposite sides having the same length as the connecting stitch length W, within the rectangular area and at a specified thread density. The thread density may be, for example, information that defines how many stitches cut across each of a unit length of a center line of an area (3 stitches/mm, for example). The thread density may be, for example, a value that is set in advance and stored in the setting storage area 152 of the HDD 15. Alternatively, a value that is specified by the user may be used.

Figure 10:
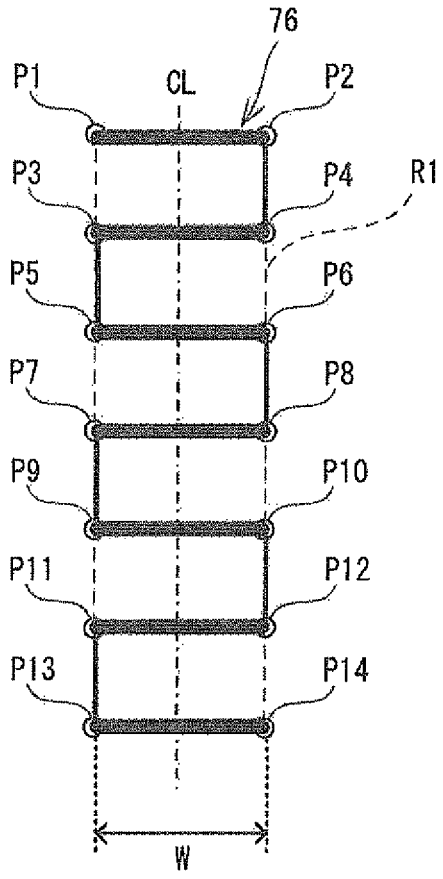
FIG. 10 is an explanatory diagram of connecting stitches that are arranged within the rectangular area shown in FIG. 7.

In the case of the rectangular area R1 explained with reference to FIG. 7, connecting data of connecting stitches 76 is generated in accordance with a thread density set by taking a center line CL as a reference, as shown in FIG. 10. The center line CL is a line that joins midpoints of a pair of opposite sides having the same length as the connecting stitch length W and that extends in a direction that intersects with those opposite sides. Specifically, the CPU 11 takes one of the vertices of the rectangular area RI as a starting point P1, and takes the diagonally opposing vertex as an end point P14, and arranges needle drop points P1 to P14, at an interval that is calculated in accordance with the thread density, on the other pair of opposite sides that intersect with the pair of opposite sides having the same length as the connecting stitch length W. The CPU 11 then calculates coordinate values of the needle drop points P1 to P14. The CPU 11 sets a sewing order in order to connect the needle drop points P1 to P14 from the starting point P1 to the end point P14, and generates the connecting data by associating the coordinate values of the needle drop points P1 to P14 with the sewing order.

Note that it is sufficient if at least one stitch is formed between the needle drop points. However, in order to firmly secure the connecting stitch, it is preferable that stitches that are formed parallel to the pair of opposite sides having the same length as the connecting stitch length W be sewn back and forth a plurality of times. For example, between the needle drop points P1 and P2 shown in FIG. 10, three stitches may be sewn in the order from P1 to P2, from P2 to P1 and from P1 to P2. This is the same for the other stitches formed in parallel to the pair of opposite sides having the same length as the connecting stitch length W, such as between the needle drop points P4 and P3 and so on.

Figure 11:
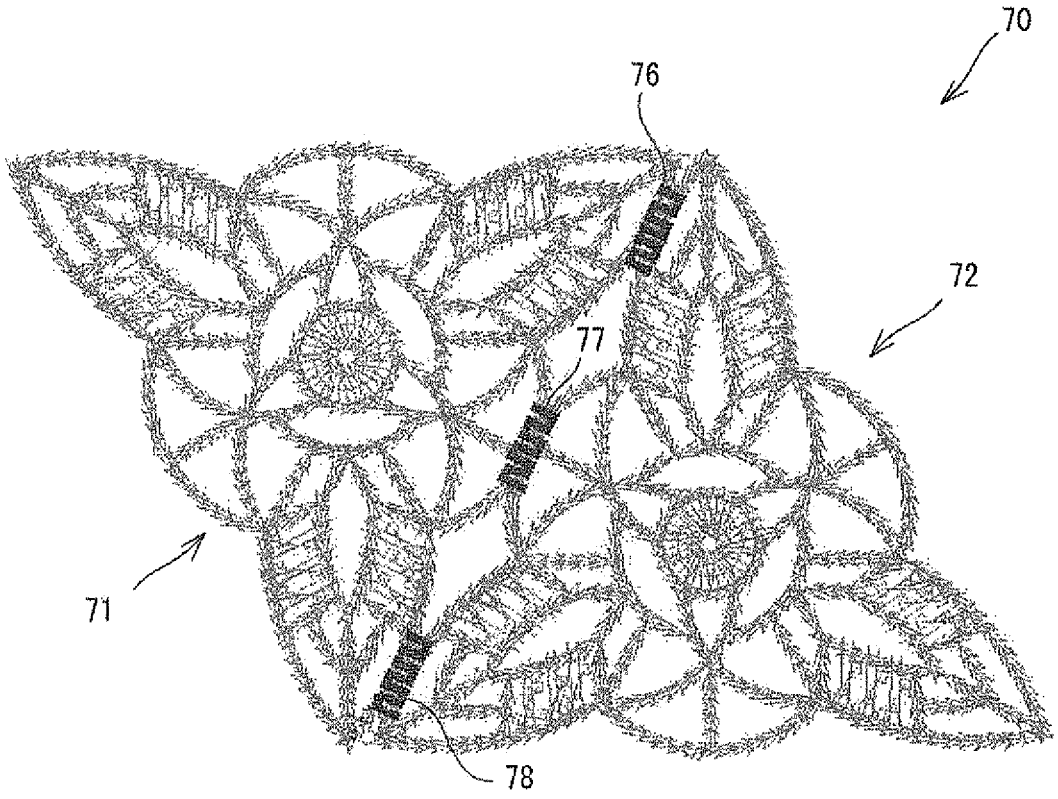
FIG. 11 is an explanatory diagram of an example of connecting stitches arranged with respect to the two patterns shown in FIG. 4.
Figure 12:
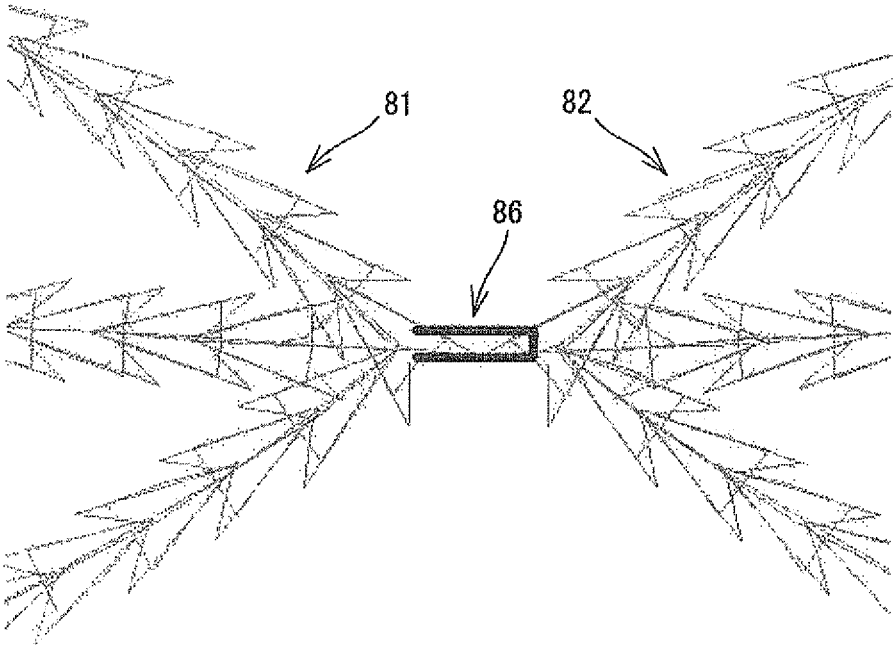
FIG. 12 is an explanatory diagram of another example of connecting stitches that is arranged with respect to stitches shown in FIG. 8.

In a case where the processing is performed in this way with the pattern 71 and the pattern 72 shown in FIG. 4 as the pattern n and the pattern F [b], groups are set respectively for the portions enclosed by the bold lines 701, 702 and 703 and the connecting stitches are arranged within corresponding rectangular areas. As a result, as shown in FIG. 11, the connecting stitches 76 (as shown in FIG. 10) and similar connecting stitches 77 and 78 are arranged in each of the portions and the corresponding connecting data is generated. Further, in the example shown in FIG. 8, connecting stitches 86 as shown in FIG. 12 are arranged inside the rectangular area R2 corresponding to the proximate pair K10 of stitches 81 and stitches 82, and the corresponding connecting data is generated.

Next, the CPU 11 adds 1 to the counter value b stored in the RAM 12 (step S211). The CPU 11 determines whether or not the counter value b has exceeded the number of connecting patterns B identified at step S203 (step S212). In a case where the counter value b does not exceed the number of connecting patterns B (no at step S212), there still remain a connecting stitch that should be created. Thus, the CPU 11 returns the processing to step S205, reads coordinate values of needle drop points of the next pattern F [b], and performs the same processing as described above (step S206 to step S212). In the example shown in FIG. 4, when the counter value b is 2 at step S211 in the first processing, the counter value b exceeds the number of connecting patterns with respect to the pattern 71, which is 1 (yes at step S212). In such a case, there are no more connecting patterns of the pattern n, and thus, the CPU 11 ends the connecting data generation processing shown in FIG. 6 and returns to the main processing shown in FIG. 3.

As shown in FIG. 3, after the connecting data generation processing (step S20), the CPU 11 generates, from the selected pattern data of the selected patterns and the connecting data, final embroidery data to sew the selected patterns in a state in which the selected patterns are connected by the connecting stitch (step S21). More specifically, the CPU 11 sets the sewing order of the needle drop points included in the connecting data and the selected pattern data such that, in the sewing order, a first needle drop point of the needle drop points of the pattern n continues subsequently to a last needle drop point of the needle drop points of the connecting stitch. The CPU 11 thus generates one set of embroidery data. In other words, when the sewing is performed in accordance with the embroidery data, the connecting stitch is sewn in advance of the pattern n and the corresponding connecting pattern. When the CPU 11 finishes generating the embroidery data, the CPU 11 advances the processing to step S22.

On the other hand, at step S11, if the return value R stored in the RAM 12 is the value indicating "NO," the CPU 11 determines that there is no connecting pattern of the processing target pattern n (no at step S11). In this case, there is no need for the connecting stitch that connects the pattern n and another selected pattern, and thus the CPU 11 advances the processing to step S22 without generating the connecting data.

At step S22, the CPU 11 adds 1 to the counter value n that identifies the selected pattern that is the processing target, and thus sets, as the processing target, the selected pattern that is next in order among the selected patterns. The CPU 11 determines whether or not the counter value n exceeds the number of patterns N (step S23). In a case where the counter value n does not exceed the number of patterns N (no at step S23), an unprocessed selected pattern still remains. Therefore, the CPU 11 returns the processing to step S10 and performs the processing as described above on the next pattern n (step S10 to step S23). In the example shown in FIG. 4, when the pattern 72 that is the second selected pattern is the processing target (n=2), there are no selected patterns that are subsequent in order to the pattern 72. Thus, in the connecting pattern verification processing (step S10), the return value remains as the value indicating "NO." As a result, the CPU 11 determines that there is no connecting pattern with respect to the pattern 72 (no at step S11). The CPU 11 sets the counter value n as 3 (step S22), which exceeds the total number of patterns of 2 (yes at step S23). In such a case, the CPU 11 ends the main processing shown in FIG. 3.

As described above, according to the embroidery data generating apparatus 1 of the present embodiment, in a case where it is necessary to create a connecting stitch that connects two selected patterns that are sewn on a sewing object formed of a soluble material, based on data of coordinate values of needle drop points included in selected pattern data of the selected patterns, one or more proximate pairs are identified. The proximate pair includes one of the needle drop points of the one selected pattern and one of the needle drop points of the other selected pattern that is within the predetermined distance D1 of the needle drop point of the one selected pattern. Further, of the proximate pairs, the proximate pair and another of the proximate pairs whose respective midpoints are within the predetermined distance D2 are set as the single group. For each group, the rectangular area is set that includes all the needle drop points forming the proximate pairs of the group and that partially overlaps with each of the two selected patterns. Then, the connecting stitch that is used to connect the two selected patterns is arranged within the rectangular area, and the connecting data is generated. Then, the final embroidery data is generated from the selected pattern data and the connecting data of the connecting stitch.

As a result, when the embroidery sewing is performed by the embroidery sewing machine 3 in accordance with the generated embroidery data, a part of the stitches of each of the selected patterns are connected by the connecting stitch. Therefore, when the sewing object is dissolved after sewing, it is possible to connect the two selected patterns using the connecting stitch while maintaining the shape and sewing quality of each of the two selected patterns, and to thus create a larger single openwork pattern. Further, the embroidery data is generated such that the sewing order of the two selected patterns is subsequent to the sewing order of the connecting stitch, and thus a part of the stitches of the selected patterns are sewn on top of the connecting stitch. As a result, the connecting stitch is inconspicuous, and it is possible to obtain the openwork pattern with an even better appearance. In addition, the connecting stitch is arranged after grouping together the proximate pairs that are positioned close to each other and setting the rectangular area, and it is thus possible to improve efficiency in comparison to a case in which the processing is performed for each pair. It is also possible to reliably connect, using the connecting stitch, the portions of the two selected patterns that are extremely close to each other. Furthermore, the value specified by the user is set as the connecting stitch length W, and thus, the user can set a desired length of the connecting stitch in accordance with the stitches of the two selected patterns.

Various modifications can be made to the above-described embodiment. For example, in the above-described embodiment, the water-soluble material and the heat-soluble material are given as examples of the soluble material. However, the soluble material may be another material that is soluble in a type of liquid. In this case, it is necessary for the liquid to be a type in which an embroidery thread does not dissolve.

In the above-described embodiment, in a case where the sewing object is the soluble material, the CPU 11 generates the connecting data only if the user specifies that it is necessary to create the connecting stitch and if one of the needle drop points of one of the two selected patterns is within the predetermined distance D1 of one of the needle drop points of the other selected pattern. In this case, the CPU 11 can perform the processing efficiently in accordance with the wishes of the user. However, the CPU 11 may always generate the connecting data in a case where the sewing object is the soluble material. Specifically, the determination processing at step S4 of the main processing, which is performed in accordance with the user specification, and the connecting pattern verification processing (step S10) may be omitted. In addition, for example, the user may specify, of the two patterns, two of the needle drop points that are close to each other, and the CPU 11 may use the specified two needle drop points as the processing target when generating the connecting data of the connecting stitch.

The value of the threshold value D1 that defines the predetermined distance used to determine the presence or absence of the connecting pattern and to identify the proximate pair is simply an example, and may be changed to another value. This also applies to the threshold value D2 that defines the predetermined distance used to group together the proximate pairs.

When grouping together the proximate pairs, the CPU 11 need not use the distance d2 between the respective midpoints. For example, in the connecting data generation processing shown in FIG. 6, the CPU 11 may omit the processing at step S207 and may perform the processing at step S208 that sequentially sets the proximate pairs that are within a predetermined distance as the same group. Further, the CPU 11 need not set the proximate pairs together as a group. Specifically, the CPU 11 may arrange the connecting stitch as shown in the examples in FIG. 8 and FIG. 12 for each proximate pair and generate the connecting data.

The shape of an area corresponding to the group of the proximate pairs may be a shape other than the rectangular shape exemplified in the embodiment, Further, the CPU 11 need not set the area corresponding to the proximate pairs. For example, the CPU 11 may identify the outer contours of the selected patterns, respectively, based on the coordinate values of the needle drop points of the selected patterns. The CPU 11 may arrange a connecting stitch that is parallel to a line segment connecting the two needle drop points that form the proximate pair and that intersects with the outer contours of the selected patterns in the vicinity of the two needle drop points. In such a case, the CPU 11 can reliably form the connecting stitch in one location at a time, in the vicinity of the proximate pair.

The sewing order of the connecting stitch need not be in advance of the two selected patterns that are to be connected, and the connecting stitch may be sewn after the two selected patterns, or may be sewn between the two selected patterns in the sewing order. In addition, in a case where the embroidery sewing is performed with embroidery threads of a plurality of colors, the CPU 11 normally groups together the needle drop points for each color, such that the stitches formed by the embroidery thread of the same color are continuous. After deciding the sewing order in each group, the CPU 11 integrates data of all the groups and generates final embroidery data. In this case also, if the stitches of the selected patterns are formed after the connecting stitch, the connecting stitch will be inconspicuous and it is possible to obtain an openwork pattern with an improved appearance. Therefore, it is preferable for the CPU 11 to set the sewing order such that the needle drop points of the connecting stitch are formed before the needle drop points of the stitches of the selected patterns, at least within the group of the same color. Note that, for example, the CPU 11 may set the color of the embroidery thread of the connecting stitch while taking into account colors of the stitches of the two selected patterns to be connected by the connecting stitch.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. An apparatus comprising:

a processor; and a memory configured to store computer-readable instructions that instruct the apparatus to perform the steps of:

acquiring first pattern data and second pattern data, the first pattern data being data representing stitches that form a first pattern, the first pattern being one of two patterns that are to be sewn by embroidery in mutually adjacent positions, and the second pattern data being data representing stitches that form a second pattern that is another one of the two patterns;

generating, in a case where the two patterns are to be sewn on a sewing object that is formed of a soluble material, connecting data based on the first pattern data and the second pattern data, the connecting data being data representing a connecting stitch, the connecting stitch being a stitch that is configured to connect the two patterns and that intersects with an outer contour of the first pattern and an outer contour of the second pattern; and generating, from the acquired first pattern data, the acquired second pattern data and the generated connecting data, embroidery data to sew the two patterns and the connecting stitch.

2. The apparatus according to claim 1, wherein the generating the embroidery data includes generating the embroidery data in which a sewing order of the stitches that form the first pattern and a sewing order of the stitches that form the second pattern are both subsequent to a sewing order of the connecting stitch.

3. The apparatus according to claim 1, wherein the computer-readable instructions instruct the apparatus to further perform the step of:

determining, based on the acquired first pattern data and the acquired second pattern data, whether to generate the connecting data, and wherein the generating the connecting data includes generating the connecting data in a case where it is determined that the connecting data is to be generated.

4. The apparatus according to claim 1, wherein the first pattern data includes first needle drop point data representing a plurality of needle drop points of the first pattern, and the second pattern data includes second needle drop point data representing a plurality of needle drop points of the second pattern, and wherein the generating the connecting data includes:

identifying, in a case where one of the plurality of needle drop points of the first pattern and one of the plurality of needle drop points of the second pattern are within a first distance, the one of the plurality of needle drop points of the first pattern and the one of the plurality of needle drop points of the second pattern as a pair, based on the first needle drop point data and the second needle drop point data;

setting an area that includes at least the two needle drop points forming the identified pair and that partially overlaps with the first pattern and the second pattern; and arranging the connecting stitch within the set area and generating the connecting data.

5. The apparatus according to claim 4, wherein the identifying the pair includes, in a case where a plurality of the pairs are identified and in a case where one of the pairs is within a second distance of an adjacent one of the pairs, sequentially identifying the pairs within the second distance and setting the identified pairs as a group, and wherein the setting the area includes, in a case where the group is set, setting the area that includes all the needle drop points forming the pairs included in the group and that partially overlaps with the first pattern and the second pattern.

6. The apparatus according to claim 1, wherein the computer-readable instructions instruct the apparatus to further perform the step of:

setting a length of the connecting stitch based on an input instruction, or on the first pattern data and the second pattern data.

7. A non-transitory computer-readable medium storing computer-readable instructions that, when executed, instruct an apparatus to execute steps comprising:

acquiring first pattern data and second pattern data, the first pattern data being data representing stitches that form a first pattern, the first pattern being one of two patterns that are to be sewn by embroidery in mutually adjacent positions, and the second pattern data being data representing stitches that form a second pattern that is another one of the two patterns;

generating, in a case where the two patterns are to be sewn on a sewing object that is formed of a soluble material, connecting data based on the first pattern data and the second pattern data, the connecting data being data representing a connecting stitch, the connecting stitch being a stitch that is configured to connect the two patterns and that intersects with an outer contour of the first pattern and an outer contour of the second pattern; and generating, from the acquired first pattern data, the acquired second pattern data and the generated connecting data, embroidery data to sew the two patterns and the connecting stitch.

8. The non-transitory computer-readable medium according to claim 7, wherein the generating the embroidery data includes generating the embroidery data in which a sewing order of the stitches that form the first pattern and a sewing order of the stitches that form the second pattern are both subsequent to a sewing order of the connecting stitch.

9. The non-transitory computer-readable medium according to claim 7, wherein the computer-readable instructions instruct the apparatus to further perform the step of:

determining, based on the acquired first pattern data and the acquired second pattern data, whether to generate the connecting data, and wherein the generating the connecting data includes generating the connecting data in a case where it is determined that the connecting data is to be generated.

10. The non-transitory computer-readable medium according to claim 7, wherein the first pattern data includes first needle drop point data representing a plurality of needle drop points of the first pattern, and the second pattern data includes second needle drop point data representing a plurality of needle drop points of the second pattern, and wherein the generating the connecting data includes:

identifying, in a case where one of the plurality of needle drop points of the first pattern and one of the plurality of needle drop points of the second pattern are within a first distance, the one of the plurality of needle drop points of the first pattern and the one of the plurality of needle drop points of the second pattern as a pair, based on the first needle drop point data and the second needle drop point data;

setting an area that includes at least the two needle drop points forming the identified pair and that partially overlaps with the first pattern and the second pattern; and arranging the connecting stitch within the set area and generating the connecting data,

11. The non-transitory computer-readable medium according to claim 10, wherein the identifying the pair includes, in a case where a plurality of the pairs are identified and in a case where one of the pairs is within a second distance of an adjacent one of the pairs, sequentially identifying the pairs within the second distance and setting the identified pairs as a group, and wherein the setting the area includes, in a case where the group is set, setting the area that includes all the needle drop points forming the pairs included in the group and that partially overlaps with the first pattern and the second pattern.

12. The non-transitory computer-readable medium according to claim 7, wherein the computer-readable instructions instruct the apparatus to further perform the step of:

setting a length of the connecting stitch based on an input instruction, or on the first pattern data and the second pattern data.

* * * * *